United States Patent [19]

Kuo et al.

[11] 4,292,159

[45] Sep. 29, 1981

[54] CELL HAVING IN SITU REDUCTION OF ELECTRODE OVERVOLTAGE

[75] Inventors: Han C. Kuo; Byung K. Ahn; Ronald L. Dotson; Kenneth E. Woodard, Jr., all of Cleveland, Tenn.

[73] Assignee: Olin Corporation, New Haven, Conn.

[21] Appl. No.: 939,942

[22] Filed: Sep. 6, 1978

Related U.S. Application Data

[60] Division of Ser. No. 853,360, Nov. 21, 1977, Pat. No. 4,160,704, which is a continuation-in-part of Ser. No. 792,389, Apr. 29, 1977, abandoned.

[51] Int. Cl.[3] ..... C25B 15/08; C25B 11/04; C25B 9/00; C25B 1/16

[52] U.S. Cl. ..... 204/237; 204/98; 204/128; 204/266; 204/290 R; 204/292

[58] Field of Search ..... 204/237, 275, 263, 265, 204/266, 257, 231, 290 R, 112, 129, 98, 113, 292

[56] References Cited

U.S. PATENT DOCUMENTS

| | | | |
|---|---|---|---|
| 1,371,698 | 3/1921 | Linder | 204/263 X |
| 1,980,381 | 11/1934 | Cain | 204/113 |
| 1,981,715 | 11/1934 | Atkinson | 204/263 X |
| 2,433,871 | 1/1948 | Sutherland et al. | 204/129 |
| 3,511,758 | 5/1970 | Bedi | 204/231 X |
| 3,617,449 | 11/1971 | Giles et al. | 204/263 X |
| 3,737,381 | 6/1973 | White et al. | 204/257 X |
| 4,030,989 | 6/1977 | Atmore et al. | 204/112 X |

*Primary Examiner*—Donald R. Valentine

*Attorney, Agent, or Firm*—Donald F. Clements; James B. Haglind

[57] ABSTRACT

A method and apparatus for in situ reduction of cathode overvoltage in electrolytic cells. The method involves introducing low overvoltage or noble metal ions into the catholyte solution and plating those ions on the cathode in situ. The apparatus includes a low overvoltage or noble metal ion generating device for introducing low overvoltage or noble metal ions into the cathode solution so as to plate them in situ on the cathode during or prior to cell operation.

1 Claim, 1 Drawing Figure

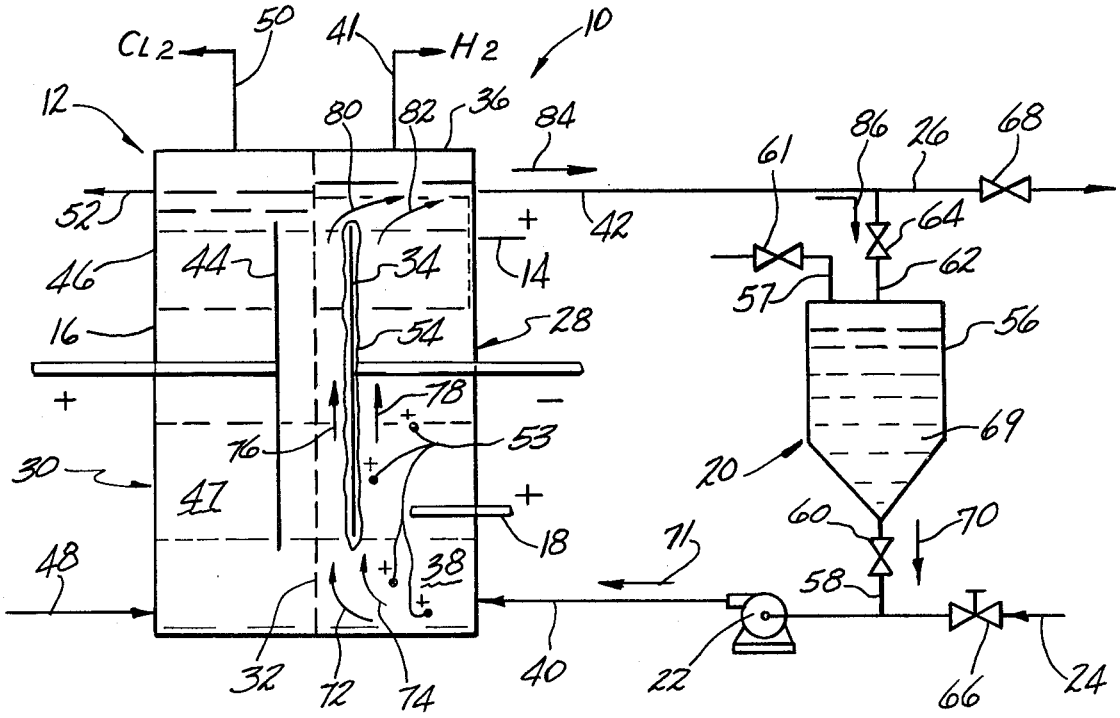
CL2
50
41
H2
10
12
80
82
36
84
86
26
68
61
52
42
64
46
44
34
14
62
57
16
54
28
56
78
53
69
76
30
47
20
60
70
18
71
48
38
58
32
72
74
40
22
66
24

CELL HAVING IN SITU REDUCTION OF ELECTRODE OVERVOLTAGE

This is a division, of application Ser. No. 853,360, filed Nov. 21, 1977, now U.S. Pat. No. 4,160,704, which is a continuation-in-part of U.S. patent application Ser. No. 792,389 filed Apr. 29, 1977, now abandoned.

This invention relates to methods and apparatuses for reduction of overvoltage in electrolytic cells.

It is well known that the voltage drop between the anode and cathode in an electrolytic cell in which gases are generated at the electrodes is made up of a number of components, one of which is the overvoltage for the particular gases and for the particular electrodes concerned. In industrial applications of electrolytic cells it is very important from the viewpoint of operating costs to reduce to a minimum the voltage drop for an electrolytic process and this therefore leads to the use of electrodes having the lowest overvoltage potentials in the system employed. A number of innovators have produced various plated electrodes for use in electrolytic cells so as to achieve a low overvoltage potential with a cathode of a base material that would otherwise have a somewhat higher overvoltage potential. U.S. Pat. No. 3,291,714, issued Dec. 13, 1966 to J. R. Hall et al gives data on many plating systems and coatings on steel or titanium substrates, the coatings being utilized to reduce hydrogen overvoltage potential. The Hall patent shows, in particular, nickel, molybdenum and tungsten based platings. Pending U.S. patent application Ser. No. 660,847 filed Feb. 24, 1976, now U.S. Pat. No. 4,033,837, by Han C. Kuo et al and assigned to Olin Corporation describes a nickel, molybdenum, vanadium alloy plating upon a copper substrate. However, these and the many other plated metal electrodes are created prior to use in the electrolytic cell and can require expensive plating equipment and time-consuming plating procedures prior to use in the cell, and thus extended cell down-time.

It is an object of present Applicant's invention to provide an in situ method for lowering hydrogen overvoltage of cathodes of electrolytic cells and apparatus for such a method.

In accordance with this and other objects, the invention provides a method for reduction of the cathodic overvoltage potential of a membrane type electrolytic cell, having a cathodic chamber, a catholyte solution and a cathode and having an anode side, which comprises the steps of:

(a) introducing low overvoltage metal ions into the catholyte solution; and (b) plating said low overvoltage metal ions, in the metallic form, on the cathode in situ.

In another aspect, the invention provides an electrolytic cell of the type having a cathode side which includes a cathode, a cathode chamber, a catholyte within the cathode chamber, a catholyte liquid inlet and a catholyte liquid outlet, and having an anode chamber and having a membrane separating said anode and cathode chambers, the improvement which comprises low overvoltage metal ion generator means, in direct fluid communication with said cathode, for generating low overvoltage metal ions and directly introducing said generated ions into the catholyte so as to be plated in situ on said cathode during operation of said cell and means for conveying catholyte liquid directly from said cathode chamber to said generator.

The objects and advantages of the invention will become apparent after reading the following description and drawing, in which:

The FIGURE is a vertical, cross-sectional, schematic diagram of an electrolytic cell utilizing various embodiments of the invention.

The invention will now be described with reference to the FIGURE which will be understood to be a depiction of certain preferred embodiments chosen by way of example and not by way of limitation.

The FIGURE is a vertical schematic FIGURE showing an electrolytic assembly 10 which comprises a cell 12, ion generators 14, 16, 18 and 20, pump means 22, catholyte feed line 24 and catholyte product withdrawal line 26.

As herein used, "low overvoltage metal" means a metal which, when plated on a cathode of a given base material, results in a lower hydrogen overvoltage than that which the base material would exhibit if unplated, where hydrogen overvoltage is defined as H and $H=E_i-E_o$ and $E_i$ is the electrode potential under load and $E_o$ the reversible potential.

As herein used, "membrane type" means having either a membrane or diaphragm whether porous, semiporous, nonporous or even an ion-exchange membrane.

As herein used, "normal manner" of anode operation implies a liquid, such as brine, is fed into the anode chamber, electric current is passed through the anode to said liquid, and a product such as chlorine gas or chlorate is produced, while ions pass through the membrane with or without accompanying fluid to become part of the catholyte.

"Complexing agent" as used herein means a chemical compound or element or ion which sequesters or chelates the low overvoltage metal ions so as to prevent their being prematurely deposited in unwanted cell areas. "Transition metal" as herein used means a metal selected from one of Groups IIIB, IVB, VB, VIB, VIIB, VIII, IB and IIB of the Long Form Chemical Periodic Table.

"Noble metal" as used herein means a metal selected from the group consisting of ruthenium, osmium, rhodium, iridium, palladium and platinum. The source of said noble metals could be noble metal oxides, chlorides or other complexes which are able to be completely dissolved or slightly dissolved in caustic solutions.

"Clean" as used herein in reference to metal surfaces means a metal surface that is sufficiently free from objectionable organic or inorganic films to allow electroplating of low overvoltage metal adherent coatings thereupon.

Cell 12 can be a conventional membrane type cell such as that shown in U.S. Pat. No. 3,898,149 issued Aug. 5, 1975 to Morton S. Kircher et al and entitled "Electrolytic Diaphragm Cell", assigned to the assignee of this invention, the entire disclosure of which is incorporated by reference as if set forth at length herein. Such a cell has suitable throwing or covering power to plate a uniform coating of low overvoltage metal ions on the cathode thereof when used in the methods of the invention. Any other cell, which simple trial and error experimentation shows to have similar "throwing power" could be used as a substitute for said Kircher cell. Cell 12 comprises a cathode side 28, an anode side 30 and a membrane 32 therebetween. Cathode side 28 includes a cathode 34, a cathode chamber 36, a catholyte 38 within the cathode chamber 36, a catholyte liquid inlet 40, catholyte gas outlet 41 and a catholyte liquid outlet 42. In a typical application, sodium ions from anode side 30 would pass into cathode chamber 36 through membrane 32 and water would be fed through catholyte liquid inlet 40 into cathode chamber 36 to form a catholyte 38 which is electrolyzed by cathode 34 to form hydrogen gas, which passes out of chamber 36 through outlet 41, and caustic soda which passes out of chamber 36 to catholyte liquid discharge 42. Anode side 30 includes an anode 44, an anode chamber 46, an anolyte 47, an anode liquid inlet 48, an anode gas outlet 50 and an anode liquid outlet 52. In a typical application, brine would be supplied to anode chamber 46 through anode liquid inlet 48 to form anolyte 47 which is electrolyzed by anode 44 to form chlorine gas which passes out of anode chamber 46 through anode gas outlet 50 and sodium ions which pass through membrane 32 and into cathode chamber 36 for further electrolysis. Other types of electrolytic cells utilizing the same or other raw materials to produce the same or other products could also make use of the invention and thus could be substituted for the particular cell 12 shown in the FIGURE.

Ion generators 14, 16, 18 and 20 are all shown in the FIGURE for clarity, however, normally only one form of ion generator would be utilized, although more than one ion generator of one or more than one form could be utilized if desired, as for example in large cells with multiple cathodes. The purposes of ion generators 14, 16, 18 and 20 are to generate low overvoltage metal ions 53 and introduce such generated ions 53 into the catholyte 38 so that said ions 53 can be deposited on cathode 34 in the form of a plating 54. One suitable plating has been found to be a uniform plating deposit of needle-shaped micro crystals of about 99 percent iron plus traces of chromium, nickel and molybdenum about one-eigth inch thick. A complexing agent can be added to the catholyte in order to sequester the low overvoltage metal ions to prevent accumulation thereof in unwanted cell areas. Also, additional metal ions, e.g. nickel ions, could be added as codeposit metal to enable metal ions such as tungsten, molybdenum and vanadium to be plated. Ion generator 14 is a wire mesh screen immersed in catholyte 38. One suitable material for the screen of ion generator 14 could be a stainless steel mesh screen. Ion generator 14 could include means for applying an electric potential to the wire mesh screen thereof so as to make the screen anodic and thus increase the corrosion of the screen and hence the rate of ion generation therefrom. Ion generator 16 is the cathode chamber itself with or without applied voltage. For example, where a stainless steel chamber is utilized, the chamber itself could be corroded to produce ions 53. Ion generator 18 is a metallic rod, and can operate to generate ions 53 in the same manner as generator 14, although the lesser surface area of a rod could necessitate the use of applied current to hasten the ion generation. Such applied current would preferably be kept to a minimum in order to prevent unnecessary production of by-products.

Ion generator 20 comprises a liquid storage tank 56, a fill tube 57, an outlet passageway 58 and an outlet valve 60 and a fill tube valve 61. Ion generator 20 preferably also comprises an inlet passageway 62 and an inlet valve 64. Outlet passageway 58 fluidly communicates storage tank 56 to catholyte inlet 40, inlet passageway 62 fluidly communicates storage tank 56 to catholyte liquid discharge 42 and fill tube 57 provides a passageway through which to fill storage tank 56. Storage tank 56 can be any suitable device for holding a supply of plating solution. Valves 60, 61 and 64 selectively open and close passageways 58, 57 and 62, respectively.

Catholyte feed line 24 includes a first shut-off valve 66 and selectively supplies water or other liquid to cathode chamber 36 for electrolysis.

Catholyte product withdrawal line 26 includes a second shut-off valve 68 and selectively receives the catholyte from cathode chamber 36 following electrolysis. One typical product is a caustic soda solution.

Pump means 22 can be provided in catholyte feed line 24 to circulate plating fluid through cathode chamber 36 as described below.

The cathode could be copper, steel or any other suitable material. Copper is preferred in order to avoid hydrogen embrittlement of the coated cathode.

Having now described the configuration of the preferred electrolytic assembly by way of example, the operation will now also be described by way of example and not by way of limitation.

Cathode chamber 36 and anode chamber 46 are filled with liquid through inlets 40 and 48, respectively and electric current is passed through cathode 34 and anode 44 by means of suitable electrical connectors to electrolyze the catholyte 38 and anolyte 47. The electrolysis produces products which vary depending on the raw materials fed to the anode and cathode chambers. In the case of an electrolytic cell designed for the production of chlorine and caustic soda, a brine solution is fed through inlet 48 to the anode chamber where it is electrolyzed to form chlorine gas and sodium ions. The chlorine gas exits through anolyte gas outlet 50 and the sodium ions pass through membrane 32 and into cathode chamber 36 for further electrolysis. To maintain upward flow in anode chamber 46 to facilitate gas removal, an anolyte liquid outlet 52 is provided to handle the overflow and the brine is introduced sufficiently fast to create a continuous overflow.

In the cathode side 28 of cell 12, water or other catholyte liquid is introduced to cathode chamber 36 from catholyte feed line 24 through catholyte liquid inlet 40 and is electrolyzed by cathode 34 to produce hydrogen and caustic or other products which pass out of cathode chamber 36 through catholyte gas outlet 41 and catholyte liquid outlet 42. Outlet 42 can lead to a catholyte product withdrawal line 26 for further processing.

Preferably, the cathode chamber 36 is flushed with water or other suitable solvent prior to the in situ plating procedure of the invention. Following such preflush, the cathode can be pre-treated in place with water and acids, e.g. organic acids such as oxalic acid, to cleanse and prepare the cathode base material for plating. In most cases a pre-treatment is not needed as the pre-flush produces a relatively clean metal surface and the plating need only be a powder plating.

Ion generator means 14 or 16 can be placed within the cathode chamber and suitable electrical potential applied thereto to enhance corrosion of metal ions therefrom for subsequent plating on cathode 34.

Pickling or dipping are not necessary in the activation process of the invention as water flushing has been found to produce an electrode with clean metal surfaces.

Valves 68 and optionally 66 are closed to prevent the catholyte from leaving the electrolytic assembly 10 via catholyte product take-off line 26 and valves 60 and 64 are opened to allow storage tank 56 to fluidly communicate with cathode chamber 36. Pump means 22 is then activated to circulate the plating solution 69 in tank 56 through cathode chamber 36 while cell 12 otherwise is being operated normally. After an amount of time, valves 68 and 66 are opened and valves 60 and 64 closed to remove storage tank 56 from fluid communication with cathode chamber 36. The amount of time valve 68 remains closed depends on the rate of plating of metal ions 53 onto cathode 34 to form plating 54 and the thickness of plating 54 desired. In one case, 20 hours was found to be a suitable amount of time to reduce the absolute value of cathode overvoltage by 120 mv. When valves 60 and 64 are open and valve 68 is closed with pump 22 on, the plating solution circulates in the direction indicated by arrows 70, 71, 72, 74, 76, 78, 80, 82, 84 and 86. Make-up liquid is continually available through valve 66 to maintain the liquid level within cathode chamber 36.

The plating solution 69 can be a solution of any low overvoltage metal ion as defined above. For a copper cathode, a suitable low overvoltage metal has been found to be one selected from the group consisting essentially of iron, nickel, chromium, molybdenum and vanadium. If molybdenum or vanadium is selected, it is necessary that a second metal be selected and codeposited therewith in order to allow plating of the molybdenum or vanadium.

Another suitable low overvoltage metal has been found to be a noble metal. One particularly suitable plating 54 has been found to be at least 99 percent iron with traces of nickel, chromium, and molybdenum. The plating solution can employ any desired solvent such as water or a caustic solution such as a solution of sodium hydroxide. As noted before, a complexing agent such as, for example, one selected from the group consisting essentially of ammonium citrate, ammonium pyrophosphate, sodium pyrophosphate, sodium citrate, ammonium tartrate, sodium tartrate and ammonium hydroxide could be utilized to sequester or chelate the low overvoltage metal ions so as to retain the metal ions in the solution by retarding the formation of metal oxides.

It will be appreciated by skilled artisans that the plating will occur only on the cathode when current is applied thereto, so no "unwanted area" exists as a site for plating. Also, other low overvoltage metals, such as other transition metals, noble metals or rare earth transition metals could be used following determination if the particular metal ion was platable and did reduce the overvoltage potential of the base material.

In order to better understand the operation of the invention, five examples of the invention will be provided:

EXAMPLE 1

A test was carried out in a small laboratory diaphragm cell with a ¼ inch diameter steel rod as a cathode. The cell was operated at 2 KA/M$^2$ based on the actual cathode area. Under normal operating condition, additional caustic (20%) saturated with dissolved ferrous sulfate, nickel oxide and sodium molybdate was slowly fed into the cathode chamber. After operating for 20 hours, the overpotential of the cathode was decreased about 120 mv. On examination of the cathode, a black coating about 1/32 inch thick was found on the cathode. The polarization curves of the cathode were checked in 36% NaOH before and after it had been operated in caustic containing the above-mentioned metal ions.

EXAMPLE 2

A stainless steel mesh (304) cathode of area 53 cm$^2$ was operated at 2 KA/M$^2$ in a bench scale membrane cell. The cathode chamber of the cell was made from stainless steel 304. After 27 days operation, the cathode chamber was corroded and thick (about ⅛ inch) uniform porous deposits were formed on the cathode surface. Tests of cathodic polarization in 36% caustic showed that the overpotential of the cathode with the thick deposits on it was about 200 mv. lower than that of the bare stainless steel cathode without the coatings. Analysis of the deposits showed the following composition: Fe-99.52%, Ni-0.17%, Cr-0.15%, Mo-0.15%, Ca-0.01%.

EXAMPLE 3

A steel mesh cathode (50 cm$^2$) was operated in a bench scale membrane cell producing 15% NaOH. The cell was operated at 2 KA/M$^2$ and gave a steady cell voltage of 3.27 v. During otherwise normal operation, a plating solution of composition: ferrous ammounium sulfate 25 g/l, ammonium tartrate 50 g/l, sodium hydroxide 100 g/l, sodium molybdate 7 g/l, was pumped to the cathode chamber and recirculated through a storage bottle. After an hour operation, the cell was shut down and the cathode chamber was rinsed with water. A black coating similar to Example 1 was present on the cathode. The cell was put back into operation after being refilled with 15% caustic in the cathode chamber. It was observed that the cathode overvoltage was decreased by about 0.1 v and the cell voltage was dropped from 3.27 v to 3.17 v after the above in-situ treatment.

EXAMPLE 4

A bench scale cell with a perfluorosulfonic acid resin membrane and a steel cathode (50 cm$^2$) had been steadily operated at 4.36 v at 2 KA/M$^2$ current density, 85° C., 275 gpl anolyte concentration and 200 gpl caustic for about 4 weeks. After the addition of 3 mg platinum oxide to the cathode compartment (300 ml in volume of the catholyte), the cell voltage decreased to a steady value of 4.25 v within 10 minutes. Table 1 shows the cell performance after the cathode was activated:

TABLE 1

| DAY | CELL VOLTAGE |
|---|---|
| 0 | 4.34 v |
| After the addition of platinum oxide | |
| 0 | 4.25 v |
| 1 | 4.27 v |
| 5 | 4.24 v |
| 8 | 4.24 v |
| 14 | 4.24 v |
| 15 | 4.22 v |

EXAMPLE 5

A bench scale cell with a perfluorosulfonic acid resin membrane and a copper mesh cathode (50 cm$^2$) had been steadily operated at 3.75 v at 2 KA/M$^2$, 85° C., 200 gpl caustic and 275 gpl anolyte concentration for about 3 weeks. After the addition of 100 mg of platinum oxide to the catholyte (300 ml in cathode compartment), the cell voltage decreased to 3.57 within 10 minutes. The following table shows the cell voltage after the platinum oxide was added.

TABLE 2

| DAY | CELL VOLTAGE |
|---|---|
| 0 | 3.75 v |
| After the addition of platinum oxide | |
| 0 | 3.55 v |
| 1 | 3.60 v |
| 5 | 3.62 v |
| 13 | 3.62 v |

As will be apparent to ordinarily skilled artisans, there are many cells having overvoltage reduction possibilities which can utilize this invention and the invention is equally applicable to such cells. Skilled artisans could conduct minor routine experimentation to determine precisely the best combination of said low overvoltage metal ions for best plating, best overvoltage reduction and best ion generation methods, among those noted could be found also by routine trial and error experimentation, and times of operation and yet still be within the scope of this invention. The following claims are to be read to cover all such equivalents.

We claim:

1. In an electrolytic cell for the electrolysis of brine to form chlorine gas and caustic soda, said cell being of the type having a cathode side which includes a hydrogen gas evolving copper cathode, a cathode chamber adapted to contain a catholyte, a catholyte liquid inlet and a catholyte liquid outlet and having an anode and an anode chamber adapted to contain a non-alkaline anolyte and said anode and having a non-adherent membrane separating said anode chamber and cathode chamber, the improvement which comprises:

low overvoltage iron ion generator means adapted to be placed in direct fluid communication with said cathode chamber, for generating iron ions and directly introducing said generating iron ions into the catholyte so as to be plated in situ on said cathode during operation of said cell, said iron ion generator means being sufficient to generate enough iron ions that the plated surface of said cathode is at least 99% iron, and means for directly conveying catholyte liquid from said cathode chamber to said generator.

* * * * *